United States Patent [19]

Kobylenski et al.

[11] Patent Number: 4,930,259

[45] Date of Patent: Jun. 5, 1990

[54] MAGNETIC DISK SUBSTRATE POLISHING ASSEMBLY

[75] Inventors: Dennis E. Kobylenski, St. Anthony; Loren W. Boehner, Maple Plain, both of Minn.

[73] Assignee: Magnetic Perpherals Inc., Minneapolis, Minn.

[21] Appl. No.: 157,824

[22] Filed: Feb. 19, 1988

[51] Int. Cl.[5] ..... B24B 21/12

[52] U.S. Cl. ..... 51/89; 51/104; 51/106 R; 51/281 SF; 51/145 R

[58] Field of Search ..... 51/154, 328, 357, 141, 51/145, 148, 135 BT, 89, 104, 105, 106

[56] References Cited

U.S. PATENT DOCUMENTS

| | | | |
|---|---|---|---|
| 543,155 | 7/1885 | Linn et al. | 51/141 |
| 637,121 | 11/1899 | Huseby | 51/141 |
| 2,469,735 | 5/1949 | Lindsay et al. | 51/141 |
| 2,802,311 | 8/1957 | Linden et al. | 51/140 |
| 3,888,050 | 6/1975 | Elm | 51/135 R |
| 3,971,163 | 7/1976 | Trombley et al. | 51/62 |
| 4,270,316 | 6/1981 | Kramer et al. | 51/283 R |
| 4,347,689 | 9/1982 | Hammond | 51/281 SF |
| 4,412,400 | 11/1983 | Hammond | 51/58 |
| 4,514,937 | 5/1985 | Gehrung et al. | 51/281 SF |
| 4,535,567 | 8/1985 | Seaborn | 51/154 |
| 4,656,790 | 4/1987 | Mukai et al. | 51/141 |
| 4,736,475 | 4/1988 | Ekhoff | 51/154 |

*Primary Examiner*—Robert Rose

*Attorney, Agent, or Firm*—Bill D. McCarthy

[57] ABSTRACT

A magnetic disk substrate polishing assembly used for polishing a surface of a disk substrate as the disk substrate is rotated, the polishing assembly comprising a polish roller having a polish cloth or polish tape continuously fed thereon. The polish roller is rotatably mounted on an assembly housing with the polish roller disposed adjacent the rotating disk blank. The polish roller is moved toward and pressed against the surface of the disk substrate with the polish tape therebetween. The polish roller is spring biased in a direction toward and perpendicular to the surface of the disk substrate which allows the roller with polish tape thereon to conform to the surface of the disk substrate so as to reduce ripples and make a uniform pattern on the polished surface of the disk substrate when the polishing operation is completed.

4 Claims, 2 Drawing Sheets

MAGNETIC DISK SUBSTRATE POLISHING ASSEMBLY

1. FIELD OF THE INVENTION

The subject invention relates to a polishing apparatus and more particularly, but not by way of limitation, to a polishing assembly for polishing the surface of a magnetic disk substrate.

2. BRIEF DESCRIPTION OF THE PRIOR ART

In the computer data storage industry it is important that aluminum nickel disk substrate on which magnetic medium is deposited be very flat and have a uniform pattern to prevent flying head crashes and to keep the flying head at a constant spacing above the medium. To obtain a flat surface having a uniform pattern, the disk is polished with a fine abrasive cloth or tape so that scratches by the tape are circular arcs centered on the disk center. In the past this has been done by holding the tape against the disk surface with a cylindrical roller, called a presser, and slowly moving the cloth over the presser while rapidly rotating the disk. This technique of polishing the disk substrate has caused ripples on the polished surface of the disk substrate.

U.S. Pat No. 4,347,689 to Hammond describes a method and apparatus for burnishing a coated recording surface of a magnetic disk. An abrasive burnishing tape is oscillated laterally back and forth across the surface of the coated surface of the disk as it is rotated on a platen. The apparatus making up this burnishing device is significantly different from the polishing assembly of the present invention.

U.S. Pat. No. 4,514,937 to Gehrung et al., U.S. Pat. No. 4,412,400 to Hammond and U.S. Pat. No. 4,656,790 to Mukai et al. describe various types of apparatus and methods using an abrasive tape for burnishing a magnetic surface of a magnetic disk.

U.S. Pat. No. 4,270,316 to Kramer et al. describes a process for evening out the amount of material removed from disks in polishing. While evening out material removed during polishing is an important consideration, the process described in this patent does not address the problem of ripples on a polished disk substrate surface upon completion of the polishing operation.

U.S. Pat. No. 3,971,163 to Trombley et al., U.S. Pat. No. 2,802,311 to Linden et al. and U.S. Pat. No. 3,888,050 to Elm are of general interest as such describe apparatuses for polishing flexible lens, metal workpieces and workpieces having deeply curved surfaces.

None of the above patents teaches the structure of the present invention for greatly reducing ripples in a disk substrate.

SUMMARY OF THE INVENTION

The present invention provides a magnetic disk substrate polishing assembly for polishing a surface of a disk substrate as the disk substrate is rotated. The polishing assembly comprises a polish roller having an abrasive polish tape continuously fed thereon. The polish roller is rotatably mounted on an assembly housing with the polish roller disposed adjacent the rotating disk substrate. The polish roller is moved toward and pressed against the surface of the disk substrate with the polish tape therebetween. The polish roller is biased by coil springs in a direction toward and perpendicular to the surface of the disk substrate which allows the roller with polish tape thereon to conform to the surface of the disk substrate so as to reduce ripples in the polished surface when the polishing operation is completed.

An object of the invention is to provide a magnetic disk substrate polishing assembly having a polish roller which will conform to the surface contour of a magnetic disk substrate.

Another object of the invention is to spring bias a polish roller against the surface of a magnetic disk substrate so that the polish roller will shift and conform to axial runout of the disk during the completion of the polishing operation.

Other objects, advantages and features of the present invention will become clear from the following detailed descriptions of the preferred embodiment when read in conjunction with the drawings and the appended claims.

DESCRIPTION

Figure 1:
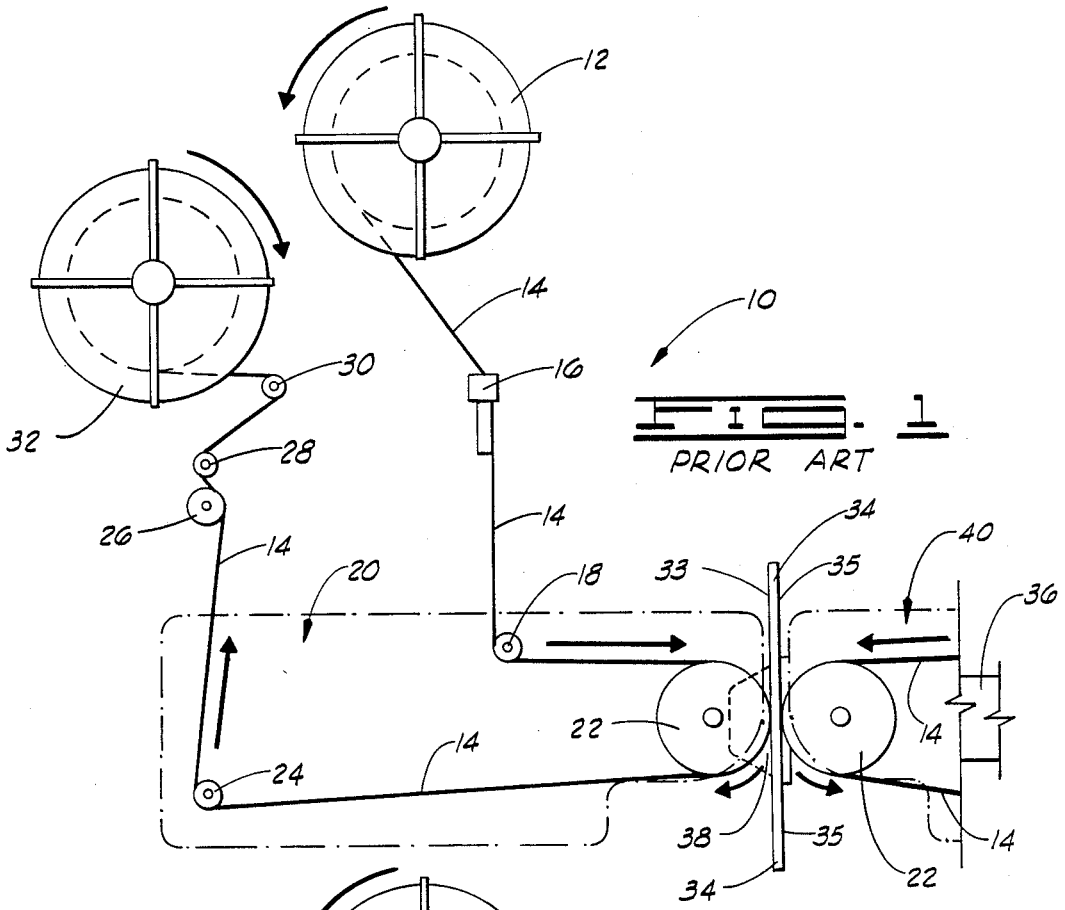
FIG. 1 PRIOR ART
FIG. 1 is a diagrammatic illustration of a prior art magnetic disk substrate polishing assembly.

In FIG. 1 a prior art magnetic disk substrate polishing assembly is shown in a diagrammatic form and designated by general reference numeral 10. The assembly 10 includes a feed reel 12 for feeding an abrasive polishing tape 14 onto a retaining idler 16 and then onto a first crowned idle roller 18 rotatably mounted on a front assembly housing 20. The tape 14 is then received around a fixed polish roller 22 and onto a second crowned idle roller 24. The polish roller 22 and second crowned idle roller 24 are also rotatably mounted on the front assembly housing 20. The tape 14 then leaves the front assembly housing 20 where it is received onto and between a knurled drive roller 26 and pinch roller 28 and then wound on an idle roller 30 before being received onto a take up reel 32.

Disposed adjacent to the polish roller 22 with tape 14 thereon is a rotating disk blank 34 mounted on a drive spindle 36 and attached thereto by a removable disk hub 38. The disk hub 38 and drive spindle 36 can be seen more clearly in FIG. 3. In operation as the disk substrate 34 is rapidly rotated, the front assembly housing 20 is moved to the right so that the tape 14 moving slowly over the surface of the polish roller 22 engages a front surface 33 of the disk substrate 34. When the polishing operation is completed the front assembly housing 20 is moved to the left disengaging the polish roller 22 and tape 14 from the front surface 33 of the disk substrate 34.

Also depicted in FIG. 1 is a portion of a rear assembly housing 40 with the polish roller 22 and tape 14 which are part of an identical magnetic disk substrate polish assembly, the same as the polish assembly 10 shown in FIG. 1, but for engaging the polishing a rear surface 35 of the disk substrate 34.

Prior to the present invention, the prior art polish assembly 10 was used to put a final surface finish on a nickel plated substrate on the front surface 33 of the disk substrate 34. But because the polish roller 22 was rigidly mounted on the assembly housing, the polish roller 22 was not free to move and conform to the contoured surface of the disk substrate 34. Since the prior art polish roller 22 was not free to move or float on the surface of the disk substrate 34, the polish roller 22 with its tape 14 would often tear the substrate, causing ripples thereon.

Figure 2:
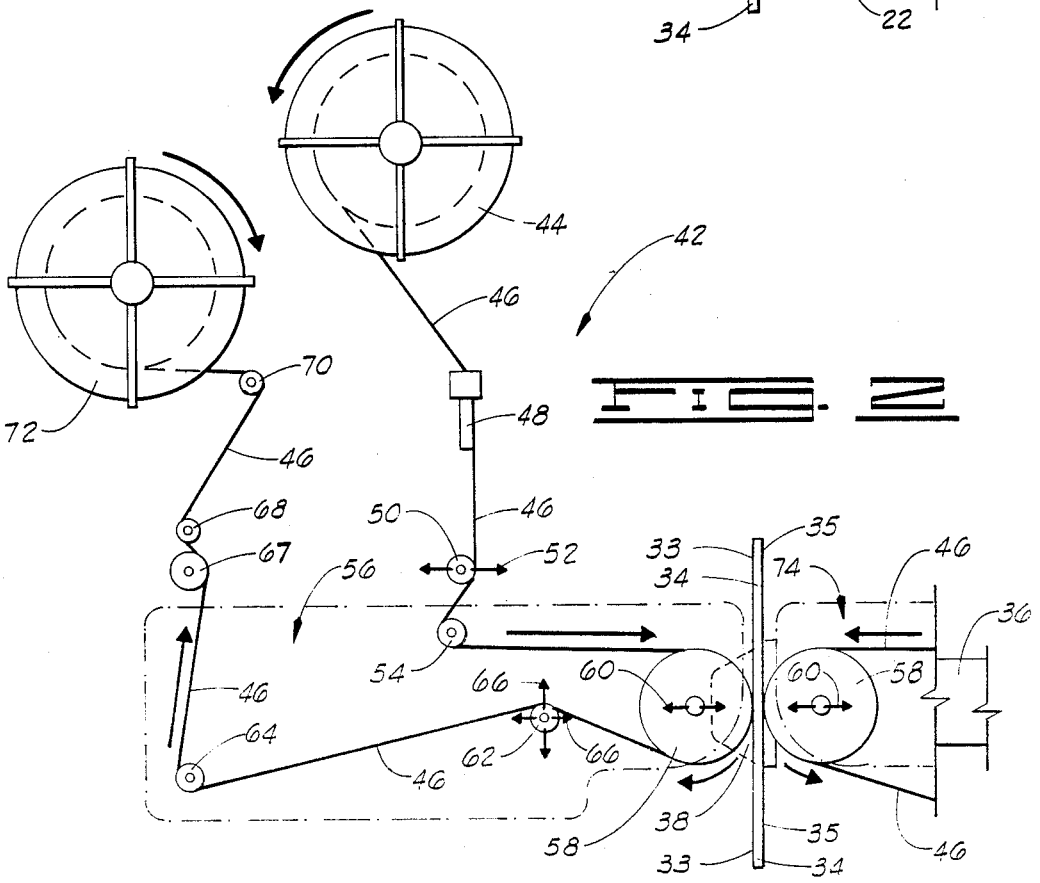
FIG. 2 is a diagrammatic illustration of the magnetic disk substrate polishing assembly constructed in accordance with the present invention.

In FIG. 2 a magnetic disk substrate polishing assembly constructed in accordance with the present invention is shown and designated by general reference numeral 42. The polishing assembly 42 includes a feed reel 44 for feeding an abrasive polishing tape 46 onto a retaining idler 48 and then onto a tracking roller 50 which is adjustable either to the left or right in a horizontal plane as indicated by arrow 52. From the tracking roller 50 the tape 46 is fed onto a crowned idle roller 54 rotatably mounted onto a front assembly housing 56. The tape 46 is then received around a spring biased polish roller 58. The polish roller 58 is biased toward and perpendicular to the disk substrate 34 which is adjacent thereto. Movement of the polish roller 58 in a plane perpendicular to the disk substrate 34 is indicated by arrow 60. The tape 46 from the polish roller 58 is fed over a crowned tracking roller 62 and a crowned idle roller 64 before exiting the front assembly housing 56. The polish roller 58, tracking roller 62 and idle roller 64 are all rotatably mounted on the front assembly housing 56 with the tracking roller 62 adjustable up and down and left to right as indicated by arrows 66. Any change in the polishing operation that moves the tape 46 off of the polish roller 58 can be compensated for by adjusting the tracking roller 62. Changes that can affect the tracking of the tape 46 on the polish roller 58 are a pressure change of the polish roller 58 against the disk substrate 34; a tranverse speed change of the polish roller 58 across the disk substrate 34; and a change of the rotational speed of the disk substrate 34.

When the tape 46 exits the front assembly housing 56 it is received onto and between a knurled drive roller 67 and pinch roller 68 and then wound on the idle roller 70 before being received onto a take up reel 72.

Disposed adjacent to the polish roller 58 with tape 46 thereon is the rotating disk substrate 34 mounted on the drive spindle 36 and attached thereto by the removable disk hub 38. Also shown in FIG. 2 is a portion of a rear assembly housing 74 with another spring biased polish roller 58 and tape 46 which are part of a magnetic disk substrate polish assembly identical in construction to the polishing assembly 42 shown in FIG. 2 but for engaging and polishing the rear surface 35 of the disk substrate 34.

Figure 3:
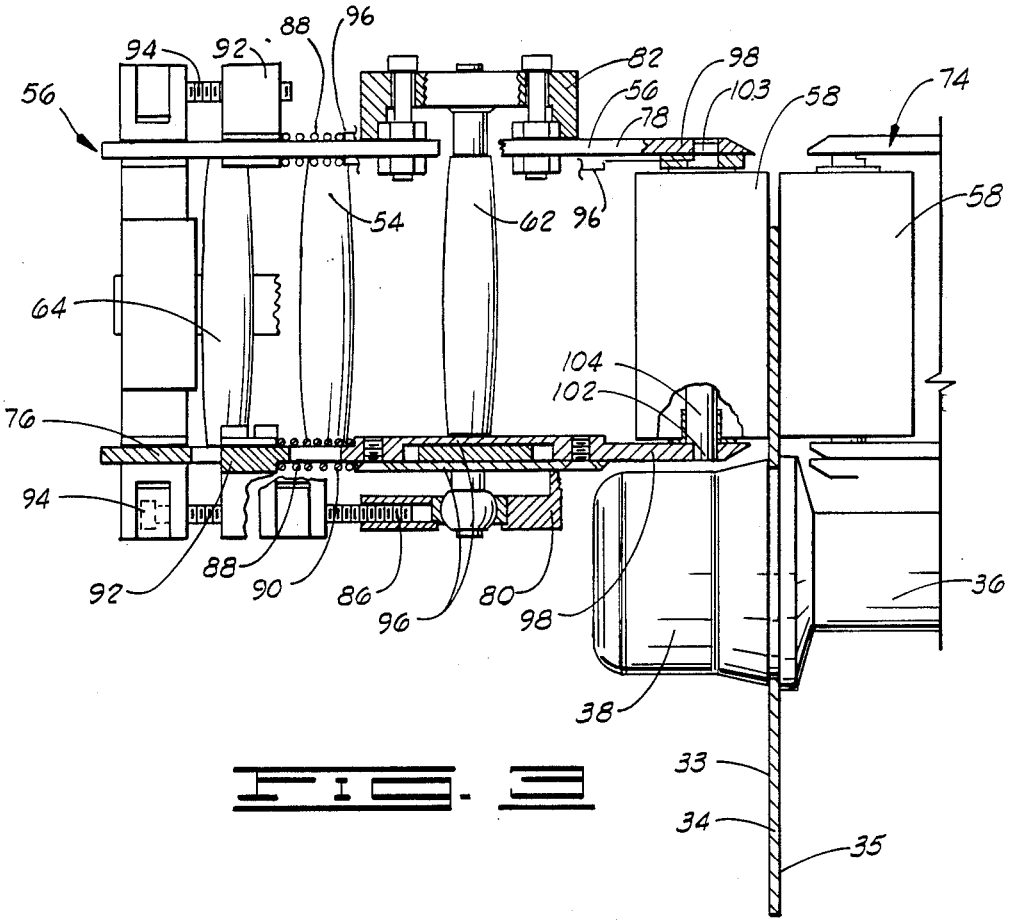
FIG. 3 is a top view of a front assembly housing, a top view of a portion of a rear assembly housing, and a rotating disk substrate therebetween.
Figure 4:
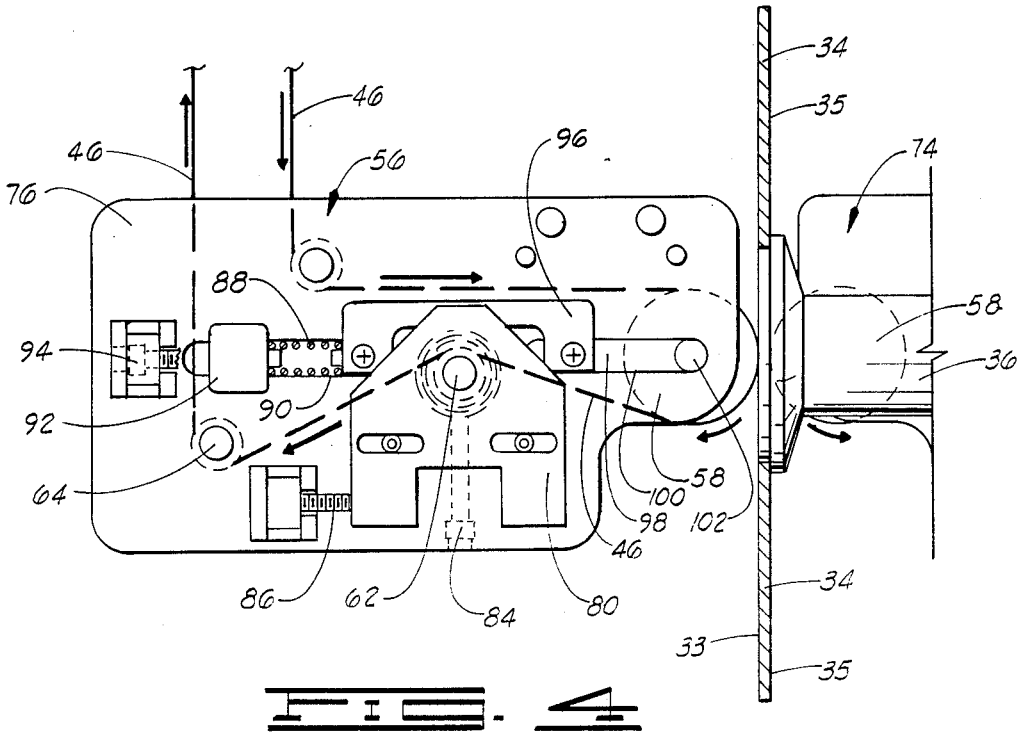
FIG. 4 is a side view of the front assembly housing, a side view of a portion of the rear assembly housing, and the rotating disk substrate shown in FIG. 3.

Referring now to FIGS. 3 and 4, top and side views of the front assembly housing 56, a portion of the rear assembly housing 74 and the disk substrate 34 with drive spindle 36 are shown. The front assembly housing 56 includes first and second side plates 76 and 78 with a portion of the side plates 76 and 78 cutaway in FIG. 3 to expose the ends of the polish roller 58, tracking roller 62 and idle roller 64 rotatably mounted thereon. The tracking roller 62 also includes adjustment plates 80 and 82 attached to the side plates 76 and 78 and including a vertical adjustment screw 84 and a horizontal adjustment screw 86. By threading the vertical adjustment screw 84 upwardly the ends of the tracking roller 62 are raised, increasing the tension on the tape 46. Also by moving the horizontal adjustment screw 86 to the right the tracking roller 62 is moved toward the polish roller 58 and the tension on the tape 46 is increased.

In FIGS. 3 and 4 a coil spring 88 is shown mounted in a first slot 90 in the side plate 76. One end of the coil spring 88 is received against a retaining block 92 which is adjusted by a tension screw 94. The other end of the coil spring 88 is urged against one end of a transfer yoke 96. The other end of the transfer yoke 96 is attached to a slot pin 98 received in a second slot 100 in the first side plate 76. The slot pin 98 engages a notched first end 102 of a polish roller shaft 104 "which extends through and supports the polish roller 58". The second side plate 78 also includes "another coil spring 88, another, transfer yoke 96, and another slot pin 98 for biasing notched second end 103 of the polish roller shaft 104. Most of this lastly detailed structure is not shown in FIG. 3 since the second side plate 78 is only partially cut away as shown.

Selective adjustment of the compression on the coil springs 88 in the side plates 76 and 78, using the tension screws 94, causes the coil springs 88 to apply a tension force on the transfer yokes 96 which move the slot pins 98 to the right, applying a bias force against the polish roller shaft 104 and the polish roller 58. Through the use of the coil springs 88 the polish roller 58 is urged toward the front surface 33 of the disk substrate 34 and perpendicular thereto. Also because the front surface 33 of the disk substrate 34 is quite often irregular, or the disk substrate 34 may be eccentrically mounted on the drive spindle 36, the polish roller 58 is free to move in a plane perpendicular to the plane of the disk substrate 34. This feature is extremely important since the polish roller 58 can now follow the undulations of the front surface 33 of the disk substrate 34.

By using the above described magnetic disk substrate polishing assembly 42 for the front surface 33 of the disk substrate 34, and a similar polishing assembly for polishing the rear surface 35 of the disk substrate 34, the likelihood of ripples on the finished polished surface is reduced and the quality of the disk substrate is greatly improved.

It is clear that the present invention is well adapted to carry out the objects and to attain the ends and advantages mentioned herein as well as those inherent in the invention. While presently preferred embodiments of the invention have been described for the purposes of this disclosure, numerous changes may be made which will readily suggest themselves to those skilled in the art and which are encompassed within the spirit of the invention disclosed and as defined in the appended claims.

What is claimed is:

1. A magnetic substrate blank polishing assembly for polishing a surface of a disk substrate as the disk substrate is rotated, the assembly comprising:

an assembly housing;

a polish roller having a roller shaft with a first end and a second end rotatably mounted on the assembly housing, the polish roller disposed adjacent the surface of the disk substrate;

a polish tape received on the polish roller;

polish tape feed means for feeding the tape onto the polish roller;

polish tape take up means for taking up the tape after the polish tape is fed onto the polish roller; and biasing means mounted on the assembly housing for engaging the first and second ends of the roller shaft and urging the polish roller toward the surface of the disk substrate with the polish tape therebetween, the biasing means comprising:

a pair of coil springs mounted on, and received in slots in, the assembly housing for applying a bias force to the first and second ends of the roller shaft; and a pair of transfer yokes attached to slot pins mounted in the assembly housing, one end of each of the coil springs engaging the transfer yokes, the slot pins engaging the first and second ends of the roller shaft.

2. The magnetic substrate blank polishing assembly of claim 1 wherein the polish tape take up means comprises a take up reel rotatably mounted on the assembly housing for receiving tape thereon.

3. The magnetic substrate blank polishing assembly of claim 2 wherein the polish tape feed means comprises roller means rotatably mounted on the assembly housing for guiding and maintaining the polish tape onto the polish roller as the polish roller is caused to be moved toward and away from the surface of the disk substrate.

4. A magnetic substrate blank polishing assembly for polishing a surface of a disk substrate as the disk substrate is rotated, the assembly comprising:

an assembly housing having a pair of slots formed therein;

a polish roller supported by a roller shaft having a first end and a second end rotatably mounted on the assembly housing, the polish roller disposed adjacent the surface of the disk substrate and the roller shaft movable perpendicularly toward and away from the disk substrate;

a polish tape received on the polish roller;

polish tape feed means for feeding and maintaining the tape onto the polish roller;

polish tape take up means for taking up the tape from the polish roller; and biasing means mounted on the assembly housing engaging the first and second ends of the roller shaft for urging the polish roller toward the surface of the disk substrate with the polish tape therebetween, the biasing means comprising:

a pair of coil springs supported by the assembly housing for applying bias force to the first and second ends of the roller shaft, each of the coil springs being received in one of the slots in the assembly housing; and a pair of transfer yokes and slot pins supported by the assembly housing, the coil springs engaging the transfer yokes and the slot pins to apply bias force to the first and second ends of the roller shaft and to permit movement of the polish roller away from the disk substrate.

* * * * *

UNITED STATES PATENT AND TRADEMARK OFFICE

CERTIFICATE OF CORRECTION

PATENT NO. : 4,930,259

DATED : June 5, 1990

INVENTOR(S) : Dennis E. Kobylenski et al.

It is certified that error appears in the above-identified patent and that said Letters Patent is hereby corrected as shown below:

Title Page - [56] References Cited, U.S. Patent Documents, delete "543,155 7/1885 Linn et al. .... 51/141" and substitute therefor: --543,155 7/1895 Linn et al. .... 51/141--;

Column 4, line 11, after "104" and before the word "which" delete the quotation mark (");

Column 4, line 12, after "58" and before the period ".", delete the quotation mark (");

Column 4, line 13, after "includes" and before "another", delete the quotation mark ("); and Column 4, line 13, after "another" and before "transfer", delete the comma (,).

Signed and Sealed this

Twentieth Day of October, 1992

*Attest:*

DOUGLAS B. COMER

*Attesting Officer*

*Acting Commissioner of Patents and Trademarks*